United States Patent [19]

Bishop

[11] Patent Number: 4,676,509

[45] Date of Patent: Jun. 30, 1987

[54] MOLDED BINGO CHIP WITH MAGNETIC STRUCTURE SECURED THEREIN

[75] Inventor: Kevin Bishop, Livermore, Calif.

[73] Assignee: Bingo Experience/ARC, Livermore, Calif.

[21] Appl. No.: 814,188

[22] Filed: Dec. 26, 1985

Related U.S. Application Data

[62] Division of Ser. No. 545,367, Oct. 25, 1983, Pat. No. 4,637,613.

[51] Int. Cl.[4] ..... A63F 3/06

[52] U.S. Cl. ..... 273/239; 273/288

[58] Field of Search ..... 273/239, 269, 288, 128 R, 273/424, 288, 289, 290, 291, 292, 293, 353, 1 M; 40/27.5, 10 A, 10 B, 10 C, 10 D

[56] References Cited

U.S. PATENT DOCUMENTS

| | | | |
|---|---|---|---|
| 1,605,703 | 11/1926 | Brown | 273/239 |
| 2,657,059 | 10/1953 | Selig | 273/239 |
| 3,766,452 | 10/1973 | Burpee et al. | 40/27.5 |
| 3,977,674 | 8/1976 | Zeller | 273/1 M |
| 4,019,747 | 4/1977 | Chuilli | 273/239 |
| 4,026,309 | 5/1977 | Howard | 40/27.5 |

*Primary Examiner*—Richard C. Pinkham
*Assistant Examiner*—Matthew L. Schneider
*Attorney, Agent, or Firm*—Limbach, Limbach & Sutton

[57] ABSTRACT

A bingo chip comprising a disk-shaped member of transparent material having a preformed slot concentrically positioned in and opening to the upper surface of the disk-shaped member. The preformed slot is shaped to accept a structure of magnetic material. The structure of magnetic material is positioned within the slot and secured in place by way of a layer of transparent material disposed over the structure and within the preformed slot.

8 Claims, 10 Drawing Figures

MOLDED BINGO CHIP WITH MAGNETIC STRUCTURE SECURED THEREIN

This is a division of application Ser. No. 545,367, filed Oct. 25, 1983, now U.S. Pat. No. 4,637,613.

TECHNICAL FIELD

The present invention is related to markers for playing bingo, and more particularly to a molded bingo chip.

BACKGROUND ART

In recent years, the game of bingo has gained substantial popularity, and a bingo gaming industry has developed to provide the implements for playing the game. As a result, there has been a significant effort toward the development of improvements in the game playing implements which are intended to make bingo playing easier and more enjoyable.

One significant development in this area was the invention of the see-through magnetically permeable bingo chip. U.S. Pat. No. 4,019,747 to Chuilli disclosed a bingo chip having a magnetic ring positioned at the circumference of a transparent disk or along the interior edge of a donut-like disk. More recently, such a feature was disclosed in U.S. Pat. No. 4,172,597 to Smith, et al wherein a magnetic mesh or screen is sandwiched between plastic sheets. In the industry, this configuration is often referred to as the "Screen Chip". Most recently, U.S. Pat. No. 4,395,043 to Gargione disclosed a bingo chip comprising a disk having a ring crimped about its periphery. In the industry, this configuration is often referred to as the "Ring Chip".

While all of the above mentioned bingo chip structures provide a see-through, magnetic bingo chip, they suffer from a number of drawbacks. With respect to the Screen Chip, pieces of the screen or mesh often protrude beyond the plastic sandwich which can scratch the surfaces of any other chips which may contact the chip during use, or injure the user. Furthermore, the screen itself tends to obscure, to a slight degree, the images which are projected through the chip.

The major drawback of the bingo chip taught by the patent to Chuilli is that its preferred embodiment is difficult to manufacture. The preferred embodiment requires that a ring having an axial thickness less than that of the plastic disk be positioned on the outer edge thereof. In turn, this requires that the outer edge of the disk be capable of supporting the ring. One technique suggested was to knurl the inner surface of the ring so as to provide a frictional-fit between the inner surface of the ring and the outer surface of the disk. The knurling so required can give rise to burrs and sharp edges which can injure the user. A further disadvantage of this structure is that the magnetic ring is positioned so that it is possible for it to abrade and scratch the surfaces of any adjacently positioned chips.

The Ring Chip structure taught by the patent to Gargione also fails to solve the problem of abrasion of other chips in that the metal ring is positioned to be in direct contact with surrounding chips. Furthermore, the positioning of the ring about the periphery of the chip exposes substantially all of the metallic surface to contamination, such as body salts from the fingertips of the user or materials on the game board surface. Moreover, the structure taught preferably uses metal which is substantially thinner than the plastic disk. This is so that the metal can be formed around the periphery of the disk. Due to the thinness of the metal and the manner in which the chips are placed on the playing surface, it is often the case that the chips become bent. In turn, this bending causes the metal to buckle, which causes the edge of the ring to rise up off of the disk. This raised edge can cause injury to the user's fingers. In the manufacturing of the Ring Chip it is difficult to consistently obtain a smooth crimp. Failure to do so results in raised edges which, in turn, have the potential to cause injury.

DESCRIPTION OF THE INVENTION

These and other problems of previous bingo chip structures are overcome by the present invention of a molded bingo marker comprising a structure of magnetic material having a predetermined shape and axial thickness, and a disk-shaped member having a slot, the sot being shaped to accept the structure of magnetic material, wherein the structure is secured within the slot of the disk.

It is, therefore, an object to the present invention to provide a bingo chip wherein a magnetic structure is positioned within a slot of a transparent disk and secured thereto.

It is another object of the present invention to provide a bingo chip comprising a disk-shaped lower member having a slot which is shaped to accept a structure of magnetic material, a structure of magnetic material disposed within the slot and a layer of material positioned over the magnetic structure and within the slot so as to secure the structure within the slot.

It is still another object of the present invention to provide a bingo chip wherein a magnetic ring is embedded within a disk of transparent material.

It is a further object of the present invention to provide a bingo chip wherein a ring of magnetic material is positioned within a disk of transparent material so that it is shielded from contact with the surfaces of other chips, contaminants and the user's fingers.

These and other features and advantages of the present invention will be more readily understood upon consideration of the following detailed description and accompanying drawings.

DETAILED DESCRIPTION OF THE INVENTION

Figure 1:
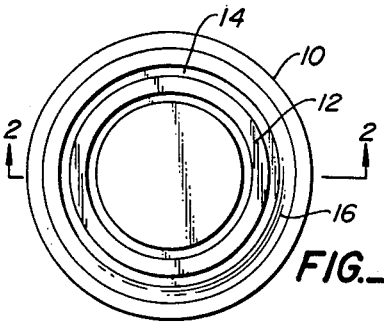
FIG. 1 is a top view of the present invention which shows a magnetic structure, such as a ring, positioned within a slot formed in a disk-shaped member.
Figure 2:
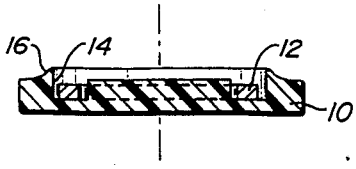
FIG. 2 shows a cut-away view of the present invention taken along lines 2—2 of FIG. 1.

Referring to FIGS. 1 and 2, the present invention will now be described in greater detail. In FIG. 1, a ring of magnetic material 12 is shown positioned within a disk 10. Ring 12 is positioned within a preformed slot 14 formed in disk 10.

Disk 10 is preferably comprised of see-through or transparent material, such as plastic. The material is preferably molded so that slot 14 is formed as a part of the molding process. Alternatively, slot 14 can be formed within disk 10 by melting an impression therein by way of a heated form.

Ring 12 is constructed from material which is attracted by a magnetic field, and preferably has an axial thickness which is no greater than the depth of the slot. In this manner, when ring 12 is positioned within slot 14, no portion of ring 12 will protrude above the surface of disk 10.

As shown in the figures, preformed slot 14 is concentrically positioned within and opens to the upper surface of disk 10. Slot 14 has an outer periphery and a bottom, both defined by disk 10. Preferably, preformed slot 14 has a depth which is less than the axial thickness of disk 10 such that preformed slot 14 does not extend through the lower surface of disk 10. Slot 14 further has a width which is less than the radial thickness of disk 10 such that is does not extend to the outer periphery of disk 10. Ring 12 is positioned within slot 14 such that its lower surface is adajcent to the bottom of slot 14. Ring 12 has a radial thickness which is less than the width of preformed slot 14 and an axial thickness which is less than the depth of preformed slot 14 such that it is spaced apart from the outer periphery of preformed slot 14 when disposed therein. Thus, when ring 12 is positioned within slot 14, no portion of ring 12 extends beyond the upper surface of disk 10 or beyond the outer periphery of preformed slot 14.

Figure 3:
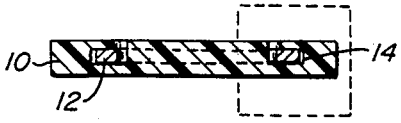
FIG. 3 illustrates one technique for securing a ring within the transparent disk-shaped member.

Ring 12 may be secured within slot 14 by way of ultrasonic welding, adhesives, or other forms of bonding. One particularly effective means for securing ring 12 within slot 14 is illustrated in FIGS. 1, 2 and 3. Preferably, a lip 16 is formed when disk 10 is molded. The lip 16 is located along the periphery of slot 14. As shown in the figures, the lip 16 is located about the outer periphery of slot 14, forming a layer over the upper surface of ring 12. It is to be understood that lip 16 can also be located along the inner periphery of slot 14; however, a greater amount of material will be required due to the smaller diameter of the lip in such a configuration. After ring 12 is positioned within slot 14, the lip 16 material is deformed by suitable means, such as a heat iron, or ultrasonic welder, so as to cover the exposed portion of ring 12. The result is shown in FIG. 3, wherein the lip 16 material has been deformed to extend over the top of ring 12.

Figure 4:
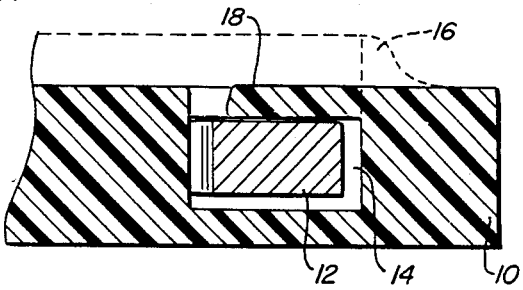
FIG. 4 is an enlarged view of the area enclosed within the dotted lines of FIG. 3.
Figure 6A:
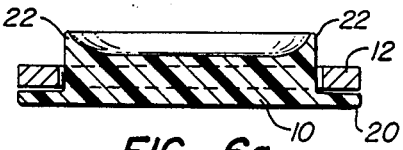
FIGS. 6*a* and 6*b* illustrate an alternative embodiment of the present invention wherein a ring of magnetic material can be positioned at the outer periphery of the see-through disk.
Figure 6B:
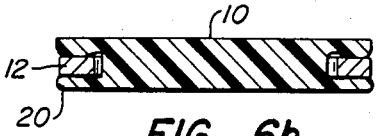
Figure 7A:
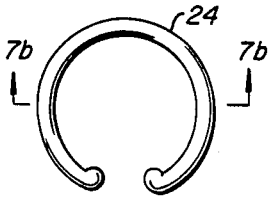
FIGS. 7*a*, 7*b* and 7*c* illustrate an alternative embodiment of the present invention.
Figure 7B:
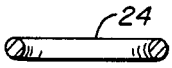
Figure 7C:
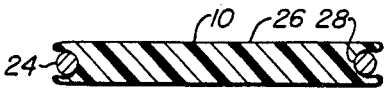

FIG. 4 shows this deformation in greater detail. FIG. 4 is an expanded view of the portion of the bingo chip enclosed within the dotted lines in FIG. 3. In FIG. 4, the dotted region illustrates the lip 16 prior to deformation. The finger of material 18 illustrates the deformed lip. It is to be understood that the extent to which slot 14 is covered by finger 18 is a function of the amount of material within lip 16. Thus, where it is desired to cover slot 14 completely, a greater amount of material will be provided in lip 16. Conversely, it is to be understood that ring 12 can be satisfactorily contained within slot 14 even where 18 extends over only a portion of slot 14.

Figure 5:
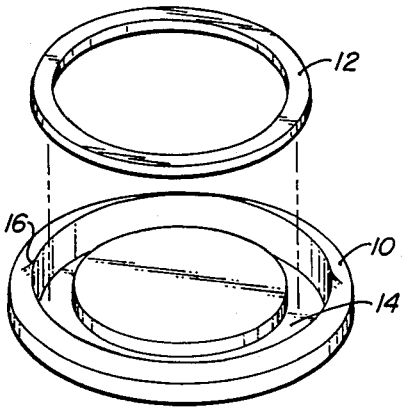
FIG. 5 is a perspective view of the interrelationship of the disk and the magnetic structure of the present invention.

Referring to FIG. 5, ring 12 is shown spaced apart from disk 10 and slot 14 to illustrate the relative positioning of each element.

Referring to FIGS. *6a* and *6b*, a alternative embodiment of the present invention is shown. There, a slot is positioned at the outer periphery of disk 10. As such, a ledge 20 is formed, upon which ring 12 is positioned. A lip 22 is formed along the vertical wall of the ledge 20. Lip 22 is deformed over the top of ring 12, as shown in FIG. *6b*.

Preferably, disk 10 can have a diameter of from three-fourths to seven-eighths of an inch, and an axial thickness of 0.050 inches. Ring 12 is preferably approximately 0.010 inches with an outer diameter of approximately 0.5 inches and an inner diameter of approximately 0.45 inches. Slot 14 is preferably 0.030 inches deep and has an outer diameter of approximately 0.575 inches and an inner diameter of approximately 0.425 inches. It is to be understood that other disk, ring and slot dimensions can be used within the spirit of the present invention.

Ring 12 can be stamped from a sheet of magnetic material. Preferably, the sheet is plated so as to inhibit corrosion of the metal.

It is to be understood that, while the present invention has been described in terms of a ring of magnetic material and a slot shaped to accept the ring, other shapes of magnetic materials and slots are envisioned to follow in the present invention. Among the shapes are ovals and polygons, including triangles, squares, rectangles, octagons and pentagons, it being understood that the slot would be shaped to accept whatever configuration of magnetic material is chosen.

Referring to FIGS. *7a*, *7b* and *7c*, an alternative embodiment of the present invention is shown. FIG. *7a* shows an alternative shape of ring 12. Instead of a completely closed ring, a split ring 24 is used. A cross section of split ring 24 is shown in FIG. *7b*. Preferably, split ring 24 has a circular cross section.

FIG. *7c* illustrates the manner in which split ring 24 is affixed to a see-through disk 26. In this embodiment, a slot 28 is formed around the periphery of see-through disk 26. Preferably, slot 28 is shaped to accept the circular cross section of split ring 24. Split ring 24 is then pressed fit into slot 28. Preferably, the ends of split ring 24 are turned inwardly to provide a biasing force against slot 28 and thereby retain ring 24 in the slot.

This alternative embodiment involves one fewer step in the manufacturing process and, as such, can be less expensive to produce.

A further variation of the above embodiment is to form the outer wall of slot 14 in FIG. 4 to have a concave shape, and to utilize a split ring 24 which can be pressed fit into slot 14 and supported by the concave vertical wall of slot 14.

In accordance with the method of the present invention, a slot is formed within a disk of see-through material, the slot being shaped to accept a structure of magnetic material. The slot is shaped to have depth which is as great as the axial thickness of the structure of magnetic material. The structure of magnetic material is positioned within the slot and secured thereto. In the preferred format of the method of the present invention, a lip of see-through material is formed along the periphery of the slot and, after the structure of magnetic material is positioned within the slot, the lip of material is deformed over the top of the structure of magnetic material, thereby securing the structure within the disk.

The above method and structure of the present invention provides a bingo chip which overcomes the drawbacks of previous bingo chips. The magnetic material is recessed within the disk and out of contact with other chips and contaminating materials. As such, there are no rough edges to abrade other chips or to injure the user. Furthermore, the magnetic material will remain substantially free of corrosion.

The terms and expressions which have been employed here are used as terms of description and not of limitations, and there is no intention, in the use of such terms and expressions of excluding equivalents of the features shown and described, or portions thereof, it being recognized that various modifications are possible within the scope of the invention claimed.

What is claimed is:

1. A bingo marker for playing bingo comprising:

a disk-shaped member having upper and lower surfaces, an outer periphery and predetermined axial and radial thicknesses, and having a preformed slot concentrically positioned in and opening to the upper surface of said disk-shaped member, wherein said slot has an outer periphery, a bottom, a depth which is less than the axial thickness of the disk-shaped member, and a width which is substantially constant and which is less than the radial thickness of said disk-shaped member, such that the outer periphery of said preformed slot does not extend to the outer periphery of the disk-shaped member and the bottom of the preformed slot does not extend to the lower surface of the disk-shaped member;

a structure of magnetic material disposed within said preformed slot, wherein said structure of magnetic material has an upper surface, an axial thickness which is less than the depth of said preformed slot and a radial thickness which is less than the width of said preformed slot, such that the structure of magnetic material is spaced apart from the outer periphery of said preformed slot and the upper surface of said structure of magnetic material does not extend beyond the upper surface of said disk-shaped member; and a layer of a material disposed over the upper surface of said structure of magnetic material and disposed within the preformed slot to secure said structure of magnetic material in the preformed slot.

2. The bingo marker according to claim 1 wherein said disk-shaped member is comprised of a transparent material.

3. The bingo marker according to claim 1 wherein said layer is comprised of a transparent material.

4. The bingo marker according to claim 1 wherein said layer has an axial thickness and the depth of said preformed slot is greater than the combined axial thicknesses of the structure of magnetic material and the layer of material.

5. The bingo marker according to claim 1 where said structure of magnetic material is shaped as a ring.

6. The bingo marker according to claim 5 wherein the outer periphery of said preformed slot is circular.

7. The bingo marker according to claim 5 wherein said preformed slot is configured as a ring.

8. The bingo marker according to claim 5 wherein said layer of material has a circular outer periphery.

* * * * *